US007936891B2

(12) United States Patent
Henricksen et al.

(10) Patent No.: US 7,936,891 B2
(45) Date of Patent: May 3, 2011

(54) LINE ARRAY ELECTROACOUSTICAL TRANSDUCING

(76) Inventors: Clifford A. Henricksen, Framingham, MA (US); Christopher B. Ickler, Sudbury, MA (US); Kenneth Dylan Jacob, Framingham, MA (US); Morten Jorgensen, Southborough, MA (US); Joseph J. Kutil, III, Franklin, MA (US); Hilmar Lehnert, Framingham, MA (US); Peter C. Santoro, Shirley, MA (US)

( * ) Notice: Subject to any disclaimer, the term of this patent is extended or adjusted under 35 U.S.C. 154(b) by 1387 days.

(21) Appl. No.: 11/246,468

(22) Filed: Oct. 6, 2005

(65) Prior Publication Data

US 2007/0092095 A1 Apr. 26, 2007

(51) Int. Cl.
*H04R 9/06* (2006.01)

(52) U.S. Cl. ..... 381/335; 381/182; 381/345

(58) Field of Classification Search ..... 381/335, 381/182, 345, 300, 370, 98, 99
See application file for complete search history.

(56) References Cited

U.S. PATENT DOCUMENTS

| | | | | |
|---|---|---|---|---|
| 3,052,758 | A | 9/1962 | Berry | |
| 3,125,181 | A | 3/1964 | Pawlowski | |
| 3,299,206 | A | 1/1967 | Klepper | |
| 4,031,318 | A | 6/1977 | Pitre | |
| 4,042,778 | A | 8/1977 | Clinton | |
| 4,223,760 | A | 9/1980 | LeTourneau | |
| 4,267,405 | A | 5/1981 | Russell | |
| 4,797,633 | A | 1/1989 | Humphrey | |
| 4,932,060 | A * | 6/1990 | Schreiber | 381/300 |
| 4,940,108 | A | 7/1990 | Selby | |
| 5,042,070 | A | 8/1991 | Linna et al. | |
| 5,309,518 | A * | 5/1994 | Ickler et al. | 381/336 |
| 5,588,063 | A | 12/1996 | Edger | |
| 5,802,190 | A | 9/1998 | Ferren | |
| 5,852,545 | A | 12/1998 | Pan-Ratzlaff et al. | |
| 5,917,923 | A * | 6/1999 | Caron et al. | 381/345 |
| 6,081,602 | A * | 6/2000 | Meyer et al. | 381/99 |
| 6,101,261 | A | 8/2000 | Brown et al. | |
| 6,215,881 | B1 | 4/2001 | Azima et al. | |

(Continued)

FOREIGN PATENT DOCUMENTS

EP 0 593 191 4/1994

(Continued)

OTHER PUBLICATIONS

Hardcopy printout of website http://www.eaw.com.

(Continued)

*Primary Examiner* — Vivian Chin
*Assistant Examiner* — Friedrich Fahnert
(74) *Attorney, Agent, or Firm* — Bose Corporation

(57) ABSTRACT

A line array loudspeaker, including a first plurality of acoustic drivers each acoustic driver comprising an axis, the first plurality of acoustic drivers arranged so that the axes of first plurality of acoustic drivers are coplanar in a first plane and so that a straight line intersects each axis at a same position on each of the first plurality of acoustic drivers, and a second plurality of acoustic drivers each acoustic driver comprising an axis, the second plurality of acoustic drivers arranged so that the axes of second plurality of acoustic drivers are coplanar in a second plane and so that the straight line intersects each axis at a same position on each of the second plurality of acoustic drivers, in which the first plurality and the second plurality arranged so that the first plane intersects with the second plane along a straight intersection line.

30 Claims, 15 Drawing Sheets

U.S. PATENT DOCUMENTS

| | | | | |
|---|---|---|---|---|
| 6,385,322 | B1 | 5/2002 | Mietling | |
| 6,394,223 | B1 * | 5/2002 | Lehman | 181/152 |
| 6,556,684 | B1 | 4/2003 | Macey | |
| 2001/0029616 | A1 | 10/2001 | Jin | |
| 2003/0174855 | A1 | 9/2003 | Hawkins et al. | |
| 2004/0096074 | A1 | 5/2004 | Bontempi et al. | |
| 2004/0264716 | A1 * | 12/2004 | Fidlin et al. | 381/161 |

FOREIGN PATENT DOCUMENTS

| | | | |
|---|---|---|---|
| EP | 649269 | A1 | 4/1995 |
| EP | 0 791 279 | | 2/1999 |
| EP | 1 199 907 | | 4/2002 |
| EP | 1199907 | A2 * | 4/2002 |
| EP | 1 494 502 | | 1/2005 |
| GB | 1 187 462 | | 4/1970 |
| JP | 06307107 | | 1/1994 |
| JP | 06225379 | | 12/1994 |
| JP | 11 243592 | | 9/1999 |
| WO | WO 96/14723 | | 5/1996 |

OTHER PUBLICATIONS

Hardcopy printout of website http://www.abtec.demon.co.uk.
"Manufacturer's Showcase", Stereophile, Oct. 2000, p. 254 (advertisement).
Hardcopy printout of website http://www.nearfieldacoustics.com.
Hardcopy printout of website http://www.duran-audio.com.
Hardcopy printout of website http://www.audiotechnology.se.
Hardcopy printout of website http://www.omnya.com.
Briggs, G.A. (Ed. Cooke, Jr., R.E.) *Loudspeakers*, pp. 313-314, © May 1948.
Augspurger, G.L., "The Colinear Array—a Two-Way Loudspeaker System" © 1970.
Smith, David L., "Discrete-Element Line Arrays—Their Modeling and Optimization", J. Audio Eng. Soc., vol. 45, No. 11, Nov. 1997, pp. 949-964.
Audio Reviews, "The Nearfield Acoustics PipeDreams: Ears Wide Open", The Sound, Issue 121, pp. 101-109.
Jordan, E.J., "Loudspeaker Enclosure Design", Wireless World, Jan. 1956, pp. 8-14; 75-79.
Jordan, E.J., "Multiple-Array Loudspeaker System", Wireless World, Mar. 1971, pp. 132-134.
Meyer, David G., "Multiple-Beam, Electronically Steered Line-Source Arrays for Sound-Reinforcement Applications," J. Audio Eng. Soc., vol. 38, No. 4, Apr. 1990, pp. 237-491.
Augspurger, G.L., et al. "An Improved Colinear Array".
Pawlowski, R. J., "The Line Radiator," Audio, Jul. 1961, pp. 19-21.
EP Examination Report dated Aug. 16, 2010 for EP Appln. No. 06815099.4.

* cited by examiner

LINE ARRAY ELECTROACOUSTICAL TRANSDUCING

BACKGROUND

This specification describes line array loudspeakers, sometimes referred to as line sources or straight-line sources. Line array loudspeakers are discussed in U.S. patent application Ser. No. 09/688,525 and at pages 35 through 36 of *Acoustical Engineering,* 1991 Edition, by Harry Olson.

SUMMARY

In one aspect of the invention, a line array loudspeaker includes a first plurality of acoustic drivers each acoustic driver comprising an axis, the first plurality of acoustic drivers arranged so that the axes of first plurality of acoustic drivers are coplanar in a first plane and so that a straight line intersects each axis at a same position on each of the first plurality of acoustic drivers. The line array further includes a second plurality of acoustic drivers each acoustic driver comprising an axis, the second plurality of acoustic drivers arranged so that the axes of second plurality of acoustic drivers are coplanar in a second plane and so that the straight line intersects each axis at a same position on each of the second plurality of acoustic drivers. The first plurality and the second plurality are arranged so that the first plane intersects with the second plane along a straight intersection line. The first plurality of acoustic drivers and the second plurality of acoustic drivers may be interleaved. The axes of at least two of the first plurality of acoustic drivers may be parallel. The same position of each of the first plurality of acoustic drivers and the same position of each of the second plurality of acoustic drivers may be the center of the dust cap.

In another aspect of the invention, a loudspeaker device includes first, second, and third acoustic drivers each acoustic driver comprising an axis, arranged along a straight line so that the axes of the acoustic drivers are perpendicular to the line. The first, second, and third acoustic drivers are further arranged so that the axes of adjacent acoustic drivers are non-parallel. The projection onto an azimuth plane of the first driver axis and a projection onto the azimuth plane of the second driver axis may intersect at an angle $\theta$, and wherein the projection onto an azimuth plane of the second driver axis and a projection onto the azimuth plane of the third driver axis may intersect at an angle $\phi$.

Angle $\phi$ may equal $-\theta$, so that the projection of the first driver and the projection of the third driver intersect at an angle $2\theta$. Angle $\phi$ may equal $\theta$ so that the projection of the first driver and the projection of the third driver are coincident. The loudspeaker device may further include a fourth acoustic driver comprising an axis, arranged along the line so that a projection onto the azimuth plane of the fourth driver axis and the projection of the second driver axis are coincident. The line may pass through the dust cover centers of the first, second, and third acoustic drivers.

In another aspect of the invention, loudspeaker device, includes a first plurality of acoustic drivers each acoustic driver comprising an axis, the plurality of acoustic drivers arranged along a straight line so that the axes of first plurality of acoustic drivers are parallel; and a second plurality of acoustic drivers, arranged along the line so that the axes of the second plurality of acoustic drivers are parallel and so that the axes of the second plurality of acoustic drivers are not parallel to the axes of the first plurality of acoustic drivers. The first plurality of acoustic drivers and the second plurality of acoustic drivers may be ordered so that each pair of the first plurality is separated by one of the second plurality. The loudspeaker device may be constructed and arranged to be placed on a surface so that the line is non-perpendicular to the surface. The loudspeaker device may be constructed and arranged to be selectively placed in one of a first orientation in which the line is parallel to the surface or of a second orientation in which the line is non-parallel to the surface. The first plurality of acoustic drivers and the second plurality of acoustic drivers may be constructed and arranged to radiate pressure waves in a first frequency band, the loudspeaker device further comprising an additional acoustic driver to radiate pressure waves in a second frequency band.

In another aspect of the invention, a monitor loudspeaker includes first, second, and third acoustic drivers, arranged along a straight line so that the axes of the loudspeakers are non-parallel. The monitor loudspeaker may be constructed and arranged to be placed on a planar surface, so that the line is non-perpendicular to the surface. The monitor loudspeaker may be further constructed and arranged to be selectively placed in one of a first orientation in which the line is parallel to the surface or of a second orientation in which the line is non-parallel to the surface. The straight line may pass through the center of the dust cover of each acoustic driver. The same position of the first plurality and the same position of the second plurality may be the only point on the first and second plurality of acoustic drivers joinable by a straight line. The straight line may pass through the centers of the dust covers of the acoustic drivers of the first and second plurality of acoustic drivers. In another aspect of the invention, a loudspeaker system, includes a first loudspeaker array, the first array comprising an enclosure having a width and a height and at least six acoustic drivers each having a radiating surfaces and an axis, each of the acoustic drivers having a diameter less than three inches. The at least six drivers are positioned in the enclosure in a first substantially straight line, substantially regularly spaced so that the edges of the radiating surfaces are less than two inches apart. The first array is designed and constructed to radiate sound wherein the acoustic drivers of a first subset of the first array have axes in a first common plane and the acoustic drivers of a second subset of the first array has axes in a second common plane and wherein the first common plane and the second common plane intersect along a straight line. The acoustic drivers of the first subset may be interleaved with the acoustic drivers of the second subset. The loudspeaker system may further include a second loudspeaker array having an enclosure and a plurality of acoustic drivers having radiating surfaces, each of the drivers having a diameter of less than three inches, the drivers positioned in the enclosure in a second substantially straight line, regularly spaced less than one inch apart. The second loudspeaker device is designed and constructed to be attached to the first loudspeaker device in a manner that extends the first substantially straight line so that the height is increased and so that the width remains constant. The first loudspeaker array may be portable.

In still another aspect of the invention, a loudspeaker system includes a first portable array module. The first portable array module includes a portable enclosure and at least six acoustic drivers, positioned in the enclosure in a substantially straight line. The first t portable array module includes two subarrays including acoustic drivers. Each driver has an axis. The axes of the first subarray are non-coplanar with the axes of the second subarray. The loudspeaker device further includes a second portable array module, which includes a portable enclosure. The loudspeaker device further includes at least six acoustic drivers, positioned in the enclosure in a substantially straight line. The second portable array module includes two subarrays having acoustic drivers. Each acoustic driver has an axis. The axes of the first subarray are non-coplanar with the axes of the second subarray. The loudspeaker device may further include an attachment system for attaching the first array to the second portable array in a manner so as to extend the substantially straight line.

Other features, objects, and advantages will become apparent from the following detailed description, when read in connection with the following drawing, in which:

DETAILED DESCRIPTION

Figure 1:
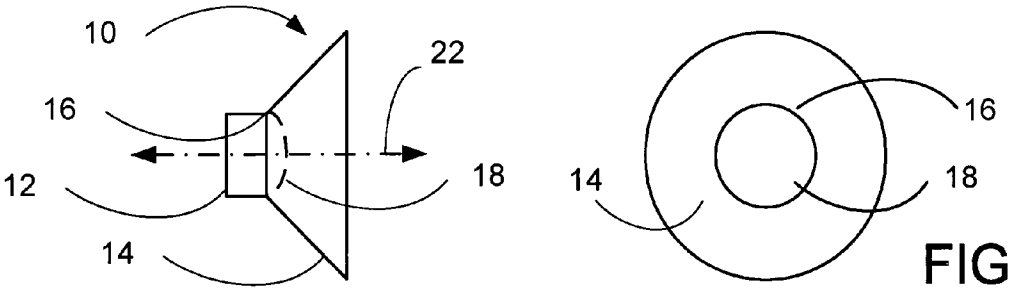
FIG. 1 is a diagrammatic view of an acoustic driver.
Figure 2A:
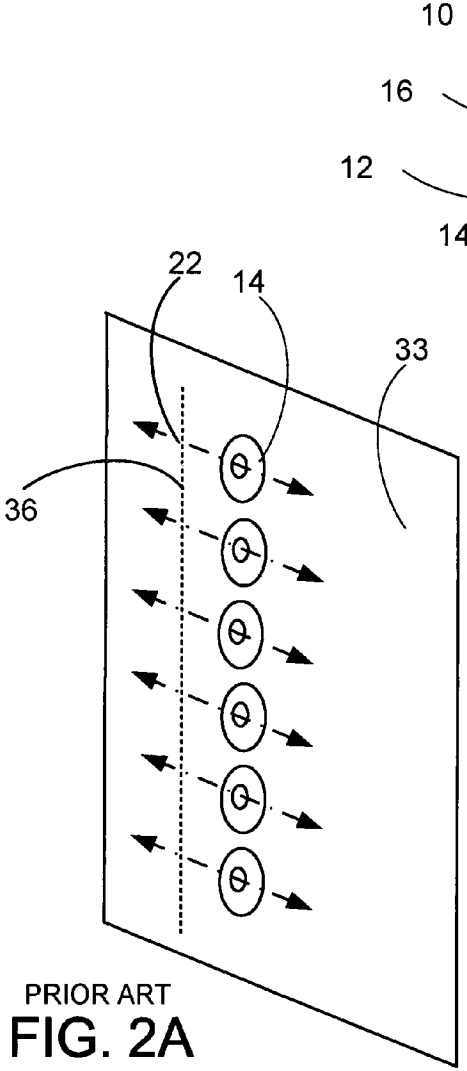
PRIOR ART FIG. 2A
FIGS. 2A-2D are diagrammatic views of a conventional line array.
Figure 2B:
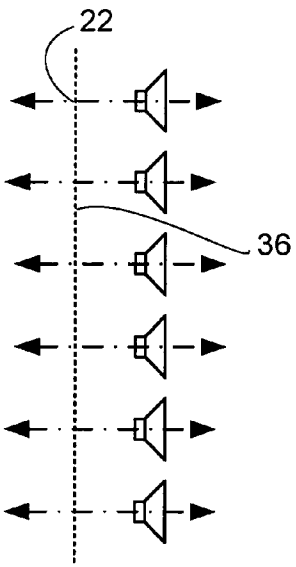
PRIOR ART FIG. 2B
Figure 2C:
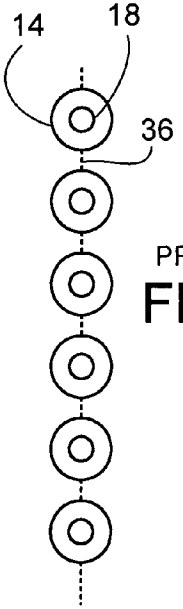
PRIOR ART FIG. 2C
Figure 2D:
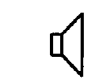
PRIOR ART FIG. 2D

Referring now to FIG. 1, there is shown an acoustic driver, for explaining some terms used in this specification. An acoustic driver 10 typically includes a motor structure 12 mechanically attached to a pressure wave radiating component 14. The pressure wave radiating component is shown as a frusto-concially shaped and is referred to as a "cone." However, a line array may be implemented using one of many other types of pressure wave radiating devices, such as dome shaped surfaces. Attached to the inner edge 16 of the cone may be a dust cover 18, typically dome shaped.

In operation, the motor structure operates as a linear motor, causing radiating surface 14 to vibrate along a axis of motion 22 (hereinafter "axis"), radiating pressure waves. Many acoustic drivers are substantially symmetric about the axis of motion 22.

FIGS. 2A-2D show a conventional line array, also for explaining some terms used in this specification. The drivers of a line array are typically arranged so that all corresponding points of the drivers are aligned along a straight line. The axes 22 of the acoustic drivers are parallel and coplanar, that is, the axes lie in a common plane 33. Since the axes are parallel, any straight line, such as reference line 36, in the common plane 33, that is perpendicular to an axis of one acoustic driver is perpendicular to the axes of the other acoustic drivers. The line array appears as FIG. 2B when viewed along a line perpendicular to the common plane 33. The line array appears as FIG. 2C when viewed along a line parallel to the axes, facing the cones. The line array appears as FIG. 2D when viewed downwards along a line parallel to line 36.

Figure 3:
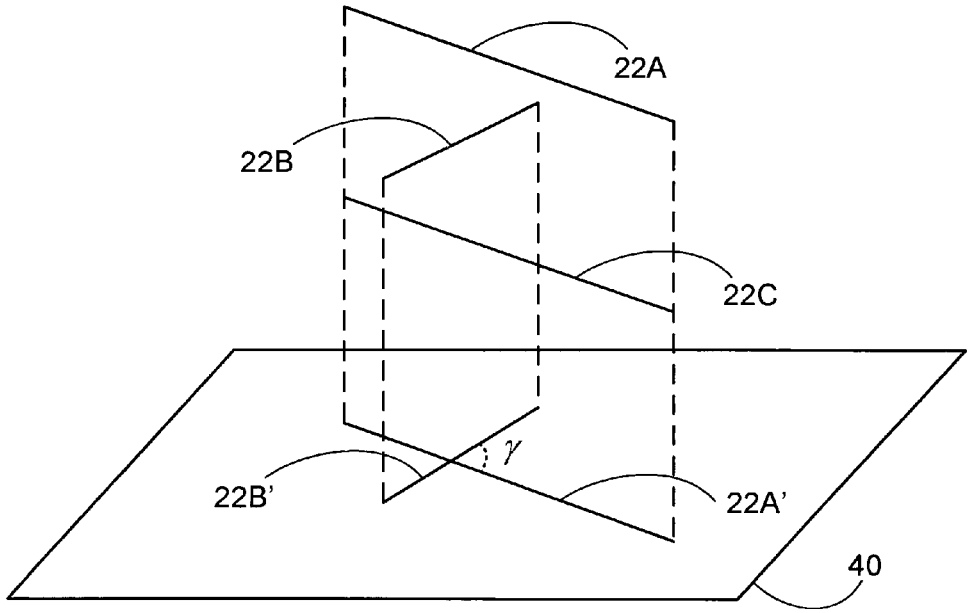
FIG. 3 is a diagram of three dimensional space for explanation of terms used in the specification.

Referring to FIG. 3, there is shown a three dimensional space for further explanation of terms used in this specification. Lines 22A and 22B represent axes of acoustic drivers. Lines 22A and 22B are skewed (that is they are non-parallel and do not intersect in three dimensional space) and are both parallel to azimuthal plane 40. Lines 22A' and 22B' are projections onto azimuthal plane 40 of lines 22A and 22B, respectively. Lines 22A' and 22B' intersect at angle $\gamma$. For convenience, "the projections of lines 22A and 22B onto the azimuth plane intersect at angle $\gamma$" will be stated as "lines 22A and 22B intersect at angle $\gamma$ in the azimuth plane". Line 22C is parallel with line 22A. The projections onto the azimuth plane of lines 22A and 22C are coincident. Hereinafter, "the projections 22A and 22C, respectively, onto the azimuth plane of lines 22A and 22C are coincident" will be expressed as "lines 22A and 22C are coincident in the azimuth plane."

Figure 4:
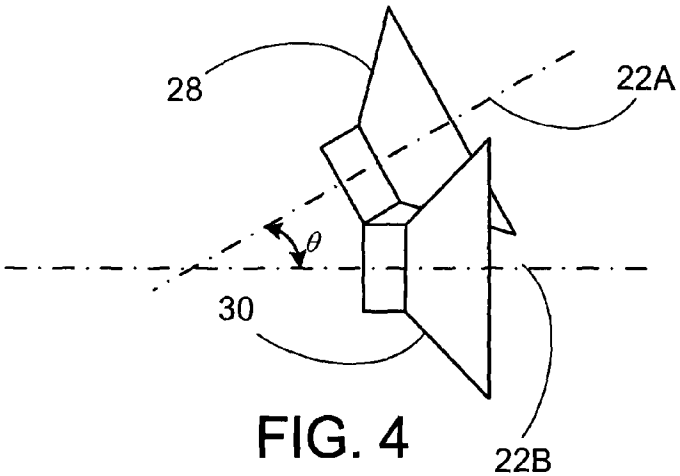
FIG. 4 is a diagrammatic view of two adjacent acoustic drivers of a line array.

Referring now to FIG. 4, there is shown diagrammatic top view (that is, a view along a line oriented as line 36 of FIGS. 2A-2C) of two adjacent acoustic drivers 28, 30 of a line array loudspeaker. In the arrangement of FIG. 4, the axes 22A and 22B are oriented so that the axes intersect at an angle $\theta$ in the azimuth plane, for example at an angle of 20 degrees or 70 degrees.

Figure 5A:
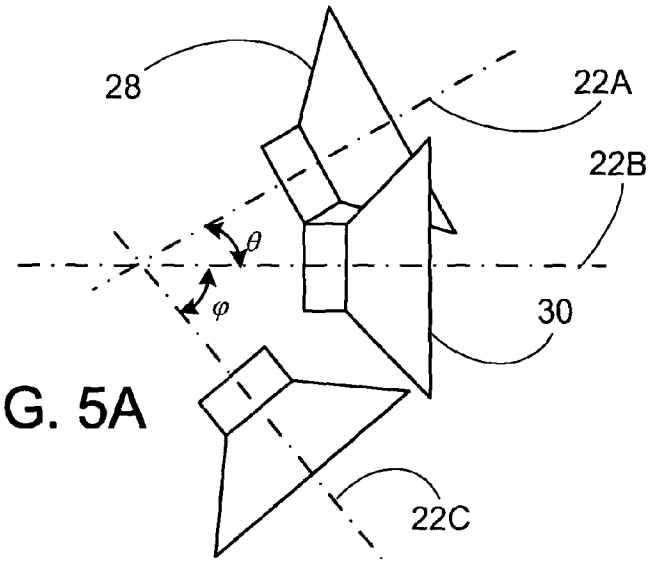
FIGS. 5A-5D are diagrammatic views of adjacent acoustic drivers of a line array.
Figure 5B:
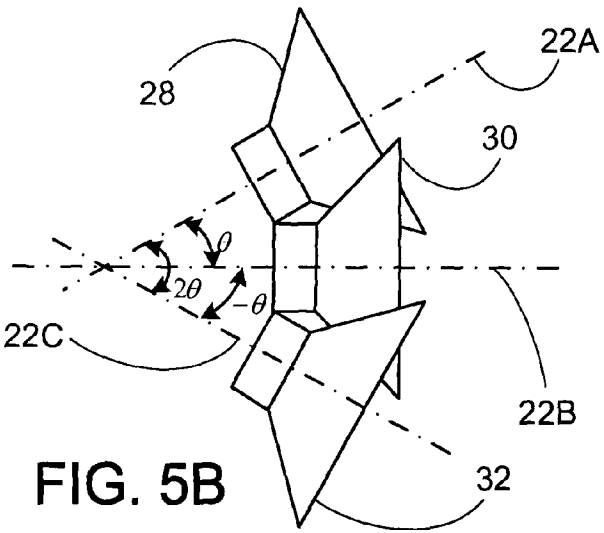
Figure 5C:
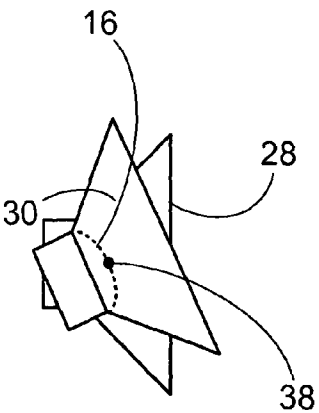
Figure 5D:
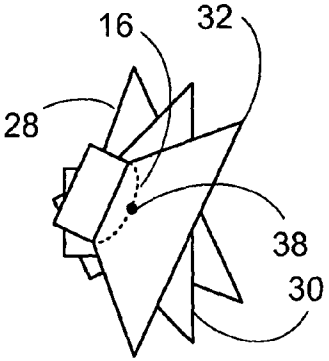

FIGS. 5A and 5B show the two adjacent acoustic drivers of FIG. 4, with a third acoustic driver 32 adjacent second acoustic driver 30. In the implementation of FIG. 5A, the third acoustic driver 32 is oriented so that line 22C intersects line 22B at an angle $\phi$ in the azimuth plane. In the implementation of FIG. 5B, angle $\phi$ of FIG. 5A is equal to $-\theta$ so that line 22C intersects line 22A at $2\theta$ degrees in the azimuth plane. "First," "second," and "third" are identifiers only, and do not necessarily designate the order of the drivers. For example, the axes of the topmost driver and the middle driver or of the bottom-most driver and the middle driver may intersect at an angle $2\theta$ in the azimuth plane. In order to more clearly show angles $\theta$ and $\phi$ in FIGS. 5A and 5B, the acoustic drivers are shown with little overlap in a top view. However, in practice, it is preferable that the acoustic drivers overlap in a top view. Increasing the amount of overlap can be done by selecting, for the point relative to the drivers through which reference line 36 passes, a point close to, or even on, the acoustic drivers. For example, FIG. 5C shows the arrangement of FIG. 4, with line 36 (which is perpendicular to the page and is indicated by the "●") passing through the centers of the dust covers of the acoustic drivers. Similarly, FIG. 5D shows the arrangement of FIG. 5B with the line 36 passing through the centers of the dust covers of the acoustic driver. In contrast to the conventional line array of FIG. 2, line 36 intersects only one corresponding point (the center of the dust cover) of all the acoustic drivers of the line array. Alignment of the dust caps may avoid on-axis phase shift aberrations that may occur if the acoustic drivers are arranged in some other manner.

Figure 6:
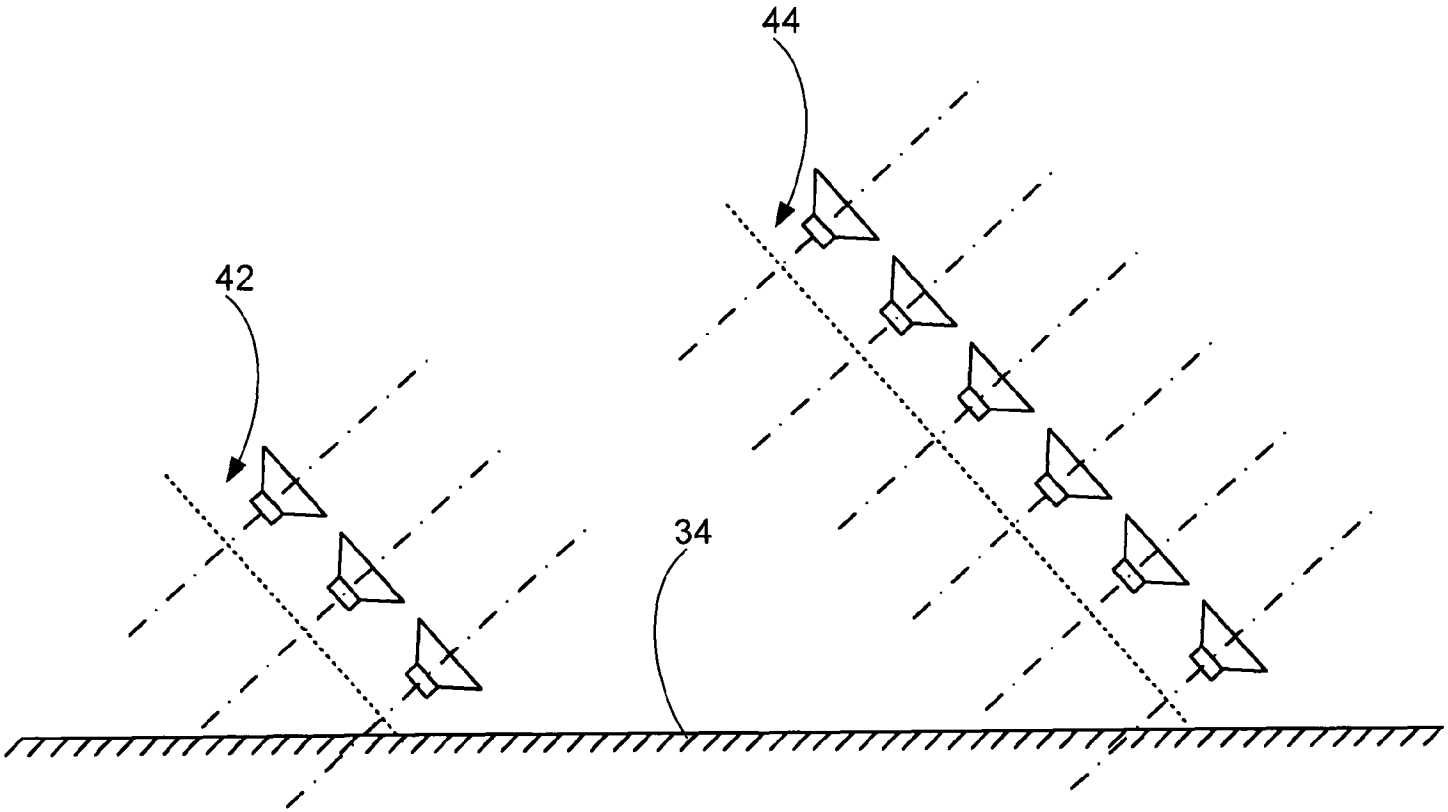
FIG. 6 are diagrammatic views of line arrays configured to be used as a monitor loudspeaker.

In one implementation of the line array, the line array is configured to be used as a monitor loudspeaker. Monitor loudspeakers are typically used with installed sound systems in medium or large venues, for example, schools, auditoria, houses of worship, or live performance venues. Monitor loudspeakers may also be used as components of professional sound systems. Monitor loudspeakers are typically placed so that the monitor loudspeaker is significantly closer to a performer or orator than to the audience. So that they do not act as a visual distraction, monitor loudspeakers are typically constructed and arranged to be placed on the floor. FIG. 6 shows a line array 42 configured to be used as a monitor loudspeaker. The line array may be oriented non-vertically, for example non-perpendicular to the floor as shown, or horizontally. Reflections off the floor 34 cause a line array to act as if its mirror image were added to the actual array. Placing the line array near the floor, as is typical with monitor speakers, can cause a line array with as few as two or three acoustic drivers to have desirable characteristics typical of line arrays with more than two or three acoustic drivers. For even better performance, the number of acoustic drivers can be increased, for example, to six as in second line array 44. In this, and in the several other views, the line array loudspeaker may radiate over the full audible frequency range, or may radiate over a limited frequency range, typically the high audible frequencies. If the line array loudspeaker radiates over a limited frequency range, the line array may be supplemented by conventional low frequency loudspeakers, which may be separate from the line array, or may be housed in the same enclosure. The line array may also include other acoustic elements, such as ports or passive radiators. The low frequency loudspeakers and other acoustic elements are not shown in FIG. 6. The acoustic drivers may be oriented as shown, or, if desired, oriented to that they appear as FIG. 5C or 5D when viewed along reference line 44.

Figure 7A:
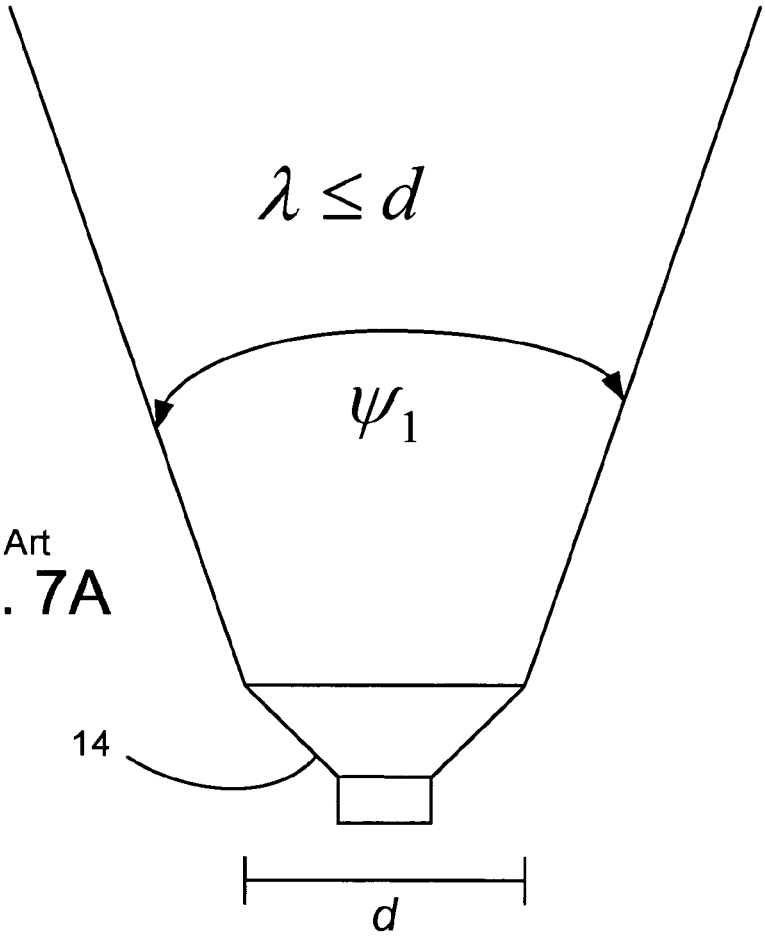
Prior Art FIG. 7A
FIGS. 7A and 7B are diagrammatic top views of line arrays.
Figure 7B:
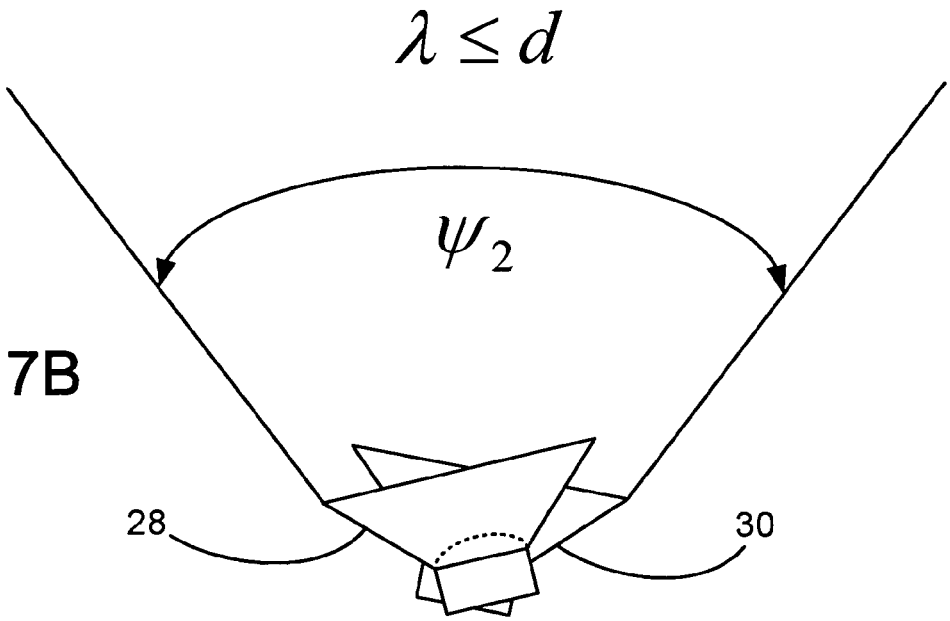
Figure 7C:
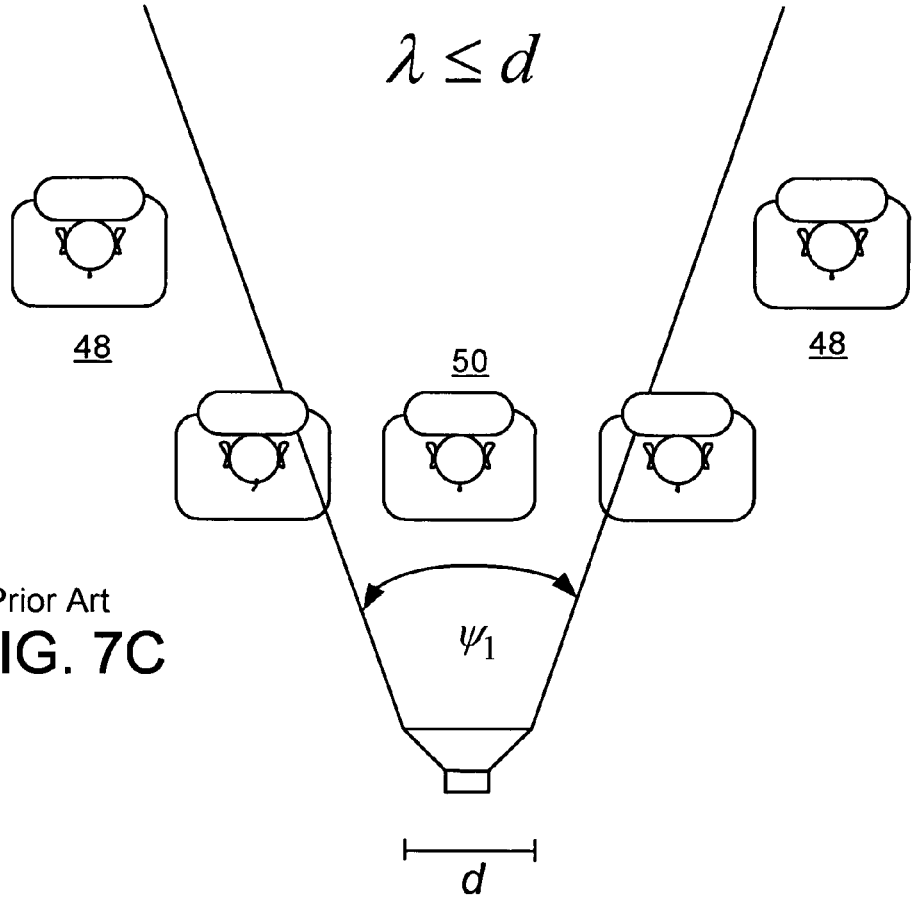
Prior Art FIG. 7C
FIG. 7C is a top diagrammatic view of a prior art loudspeaker illustrating horizontal dispersion.
Figure 7D:
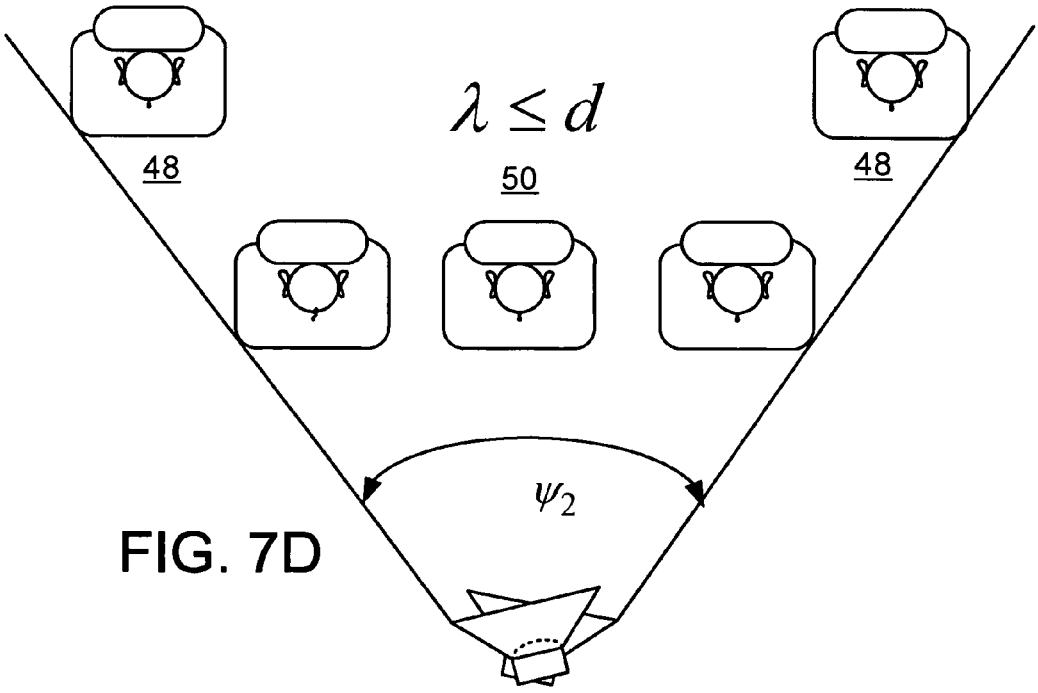
FIG. 7D is a top diagrammatic view of a line array illustrating horizontal dispersion.

Referring to FIGS. 7A and 7B, there are shown top views of line arrays for illustrating an advantage of the invention. At frequencies corresponding to wavelengths ($\lambda$) comparable to or smaller than the diameter d of the cones, the pressure wave radiation starts to become directional. As a result, the horizontal dispersion (indicated by angle $\psi_1$) may become narrower than desired at those frequencies, as shown in the conventional line array of FIG. 7A. Orienting the acoustic drivers of the line array according to the configurations of FIGS. 4-5D, as shown in FIG. 7B increases the horizontal dispersion $\psi_2$ so that there is adequate horizontal dispersion at frequencies corresponding to wavelengths comparable to or smaller than the diameter of the acoustic drivers. FIGS. 7C and 7D illustrate the effect of the horizontal dispersion patterns of FIGS. 7A and 7B. The figures are for purposes of illustration and are not drawn to scale. With the horizontal dispersion pattern of FIG. 7A, as shown in FIG. 7C, at frequencies corresponding to wavelengths comparable to or smaller than the diameter of the acoustic drivers, some portions 48 of an audience may be outside the horizontal dispersion angle $\psi_1$ and those portions of the audience may receive significantly less high frequency radiation than other portions 50 of the audience. With the horizontal dispersion pattern of FIG. 7B, as shown in FIG. 7D, the portions 48 of the audience receive similar levels of high frequency radiation as other portions 50 of the audience.

Figure 8:
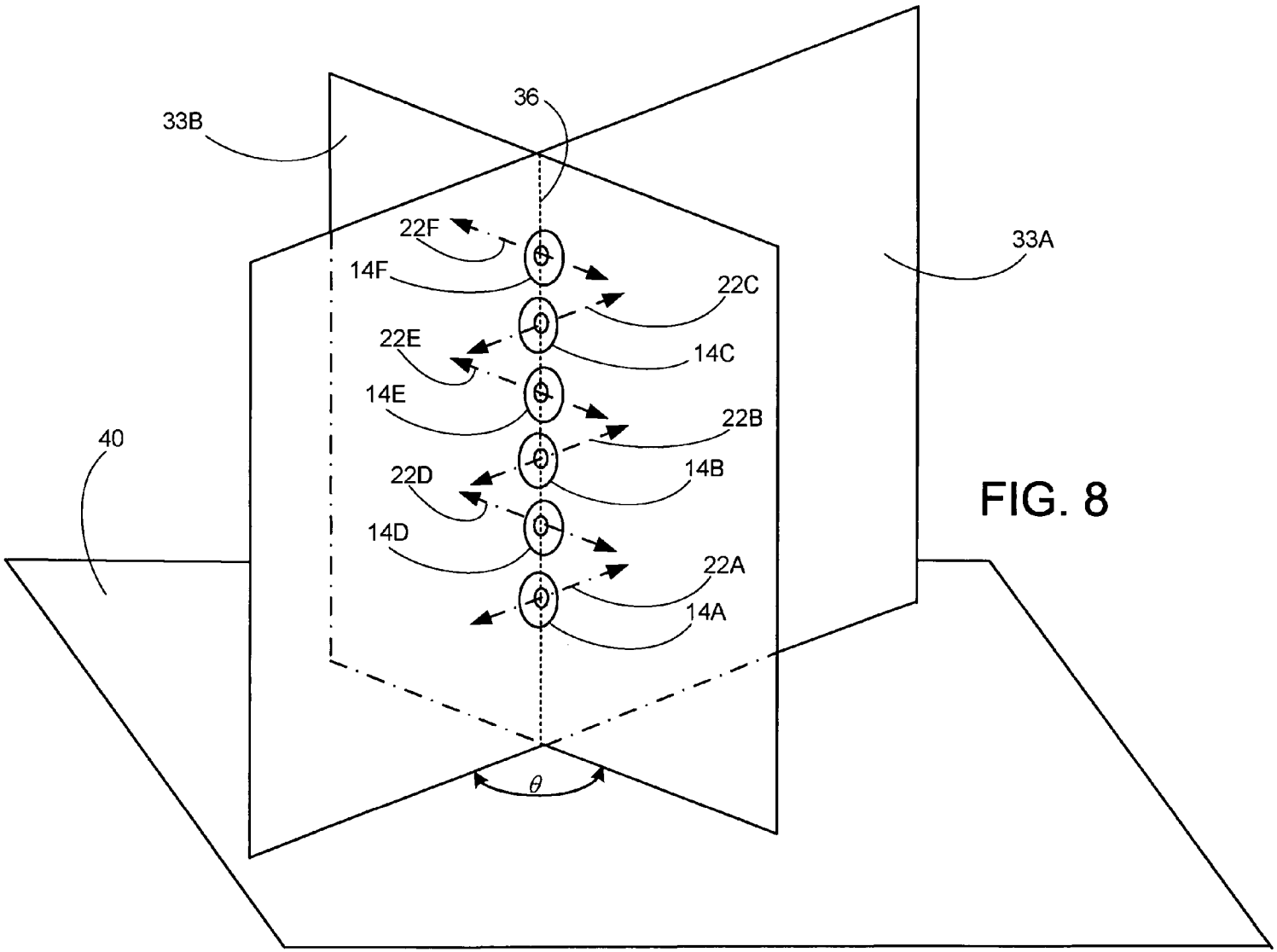
FIG. 8 is a diagrammatic three dimensional representation of a line array

Referring to FIG. 8, there is shown a three dimensional representation of a line array employing aspects of previous figures. The line array of FIG. 8 includes two portions, each configured like the line array of FIG. 1. A first line array portion includes acoustic drivers 14A, 14B, and 14C which have axes 22A, 22B, and 22C respectively that are parallel and coplanar in plane 33A, as discussed above in FIG. 2. A second line array portion includes acoustic drivers 14D, 14E, and 14F which have axes 22D, 22E, and 22F, respectively that are parallel and coplanar in plane 33B. Planes 33A and 33B intersect at line 36. The acoustic drivers are positioned so that line 36 is perpendicular to axes 22A-22F and pass through the centers of the dust covers of the acoustic drivers. Plane 40 is an azimuth plane as described above in the discussion of FIG. 3. Plane 33A and plane 33B intersect at plane 40 at an angle $\theta$, for example at 70 degrees. The acoustic drivers from the first portion and the acoustic drivers from the second portion are interleaved, so that each of the acoustic drivers (14A, 14B, 14C) of the first line array portion is separated from the nearest acoustic driver of the first portion by an acoustic driver (14D, 14E, 14F) of the second portion and to that each of the acoustic drivers (14D, 14E, 14F) of the second line array portion is separated from the nearest acoustic driver of the second portion by an acoustic driver (14A, 14B, 14C) of the first portion. Each adjacent pair of acoustic drivers includes one acoustic driver from the first portion and one acoustic driver from the second portion. As compared with conventional line arrays, a line array according to FIG. 8 has the greater horizontal dispersion at higher frequencies as described in the discussion of FIG. 7B over substantially the entire length of the line array.

Figure 9A:
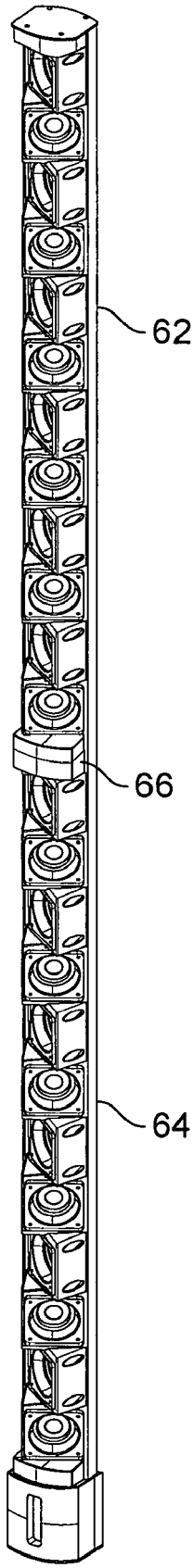
FIG. 9A-9F are views of a practical implementation of a line array according to the specification.
Figure 9B:
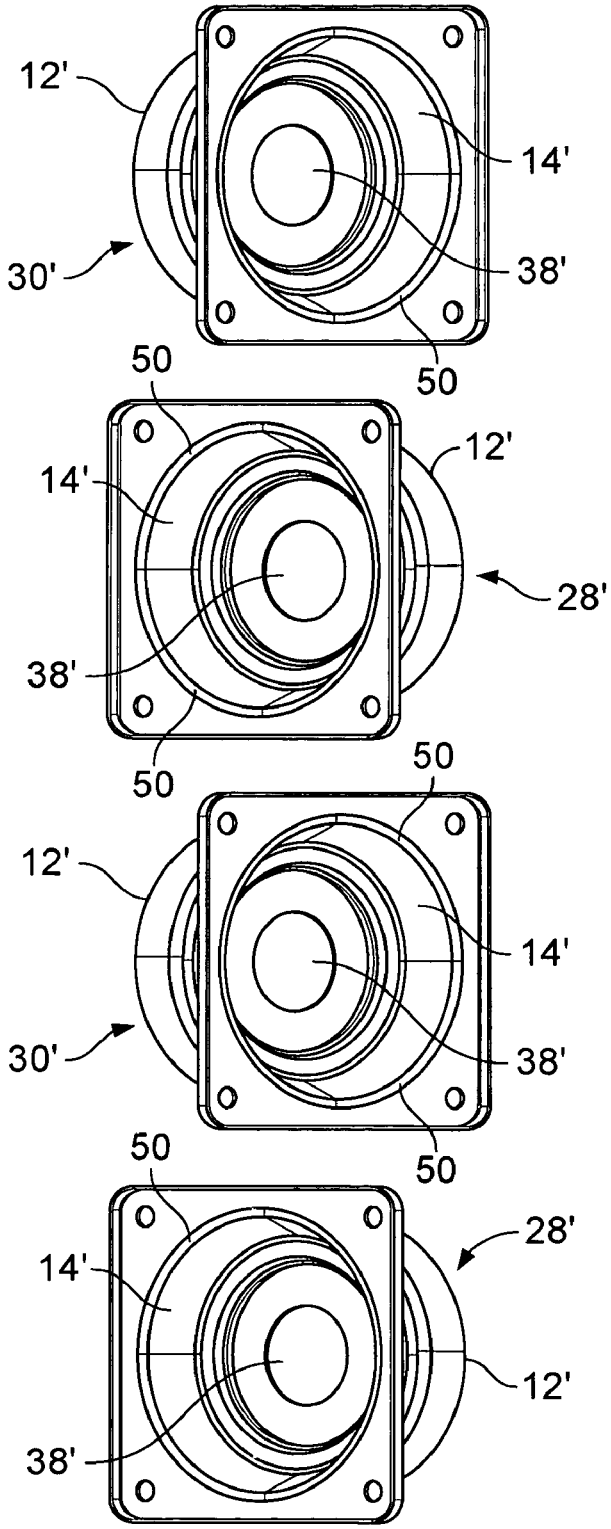
Figure 9C:
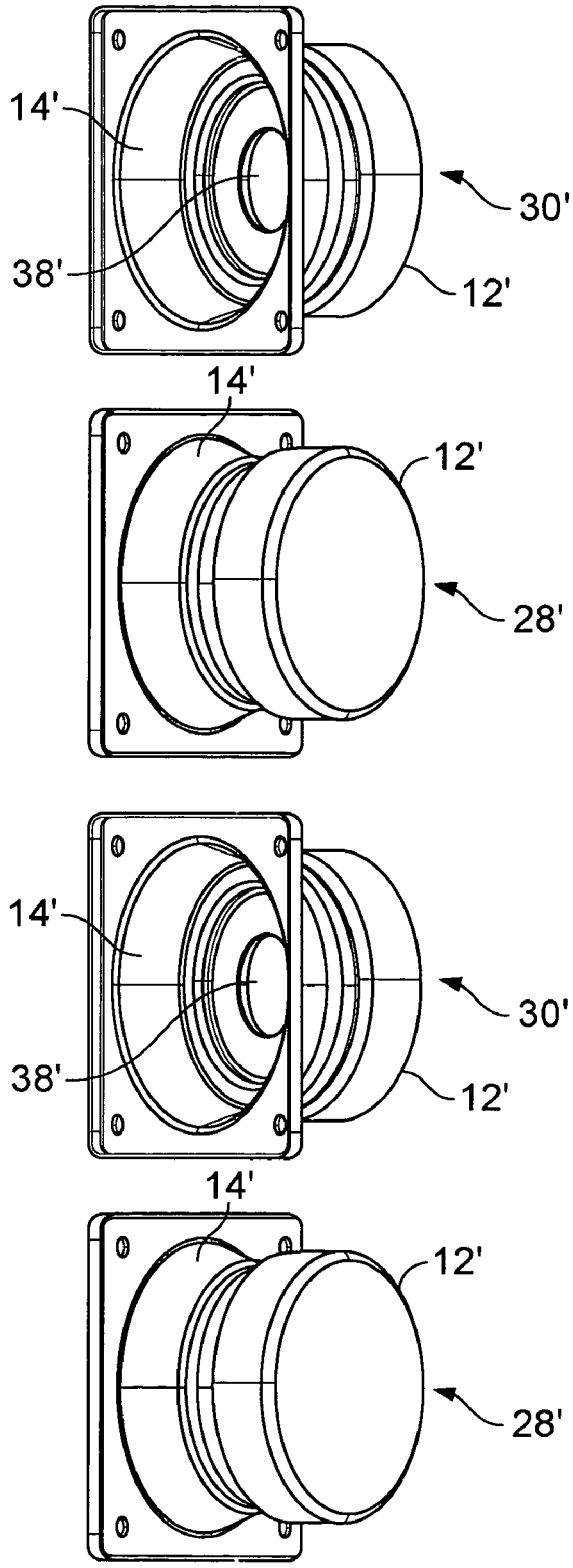
Figure 9D:
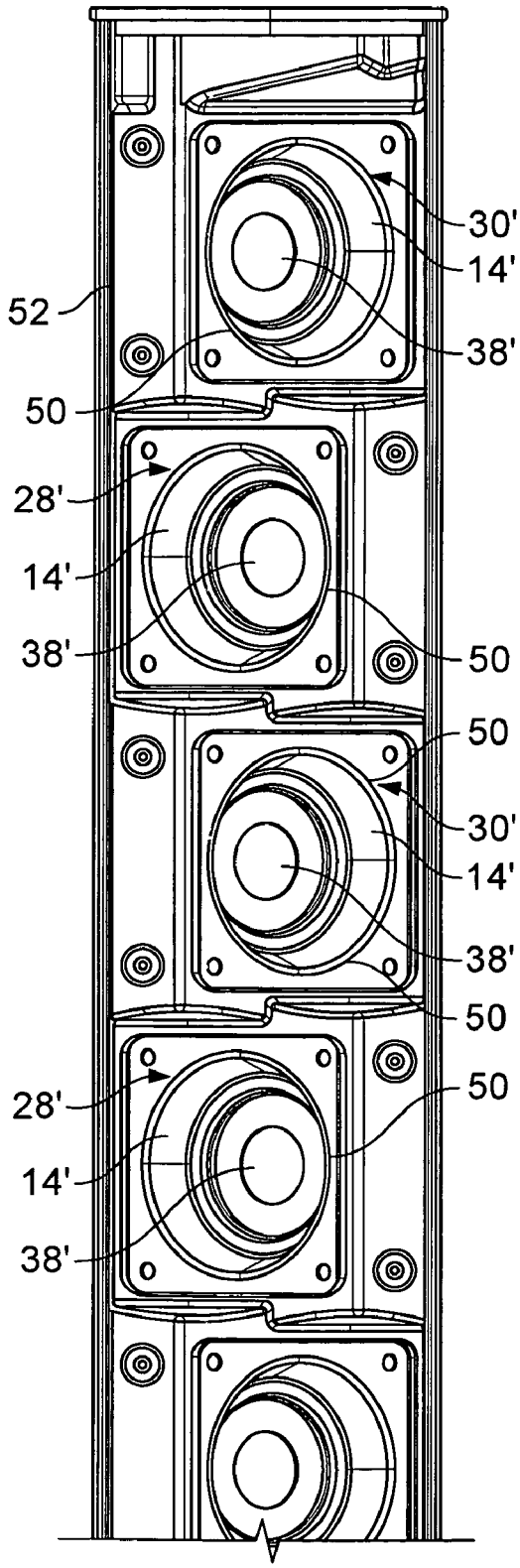
Figure 9E:
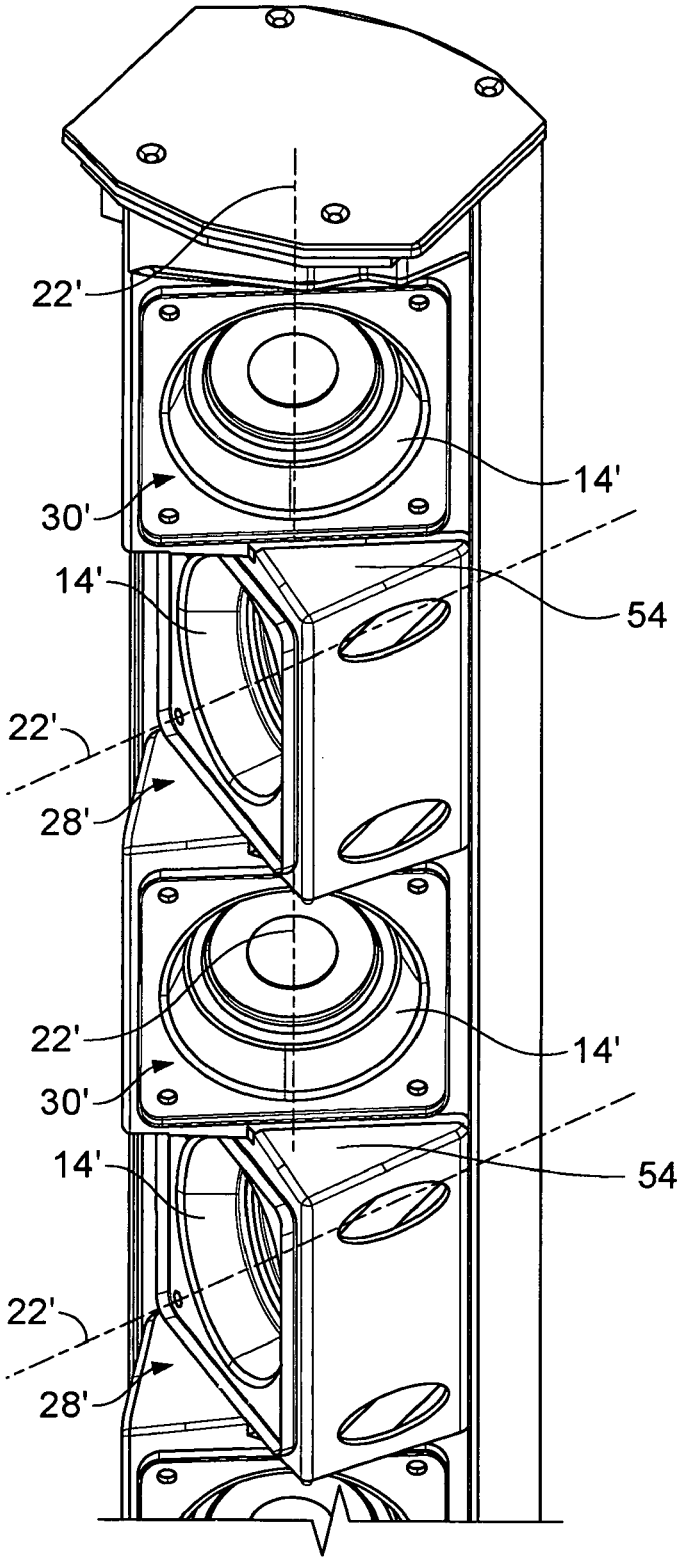
Figure 9F:
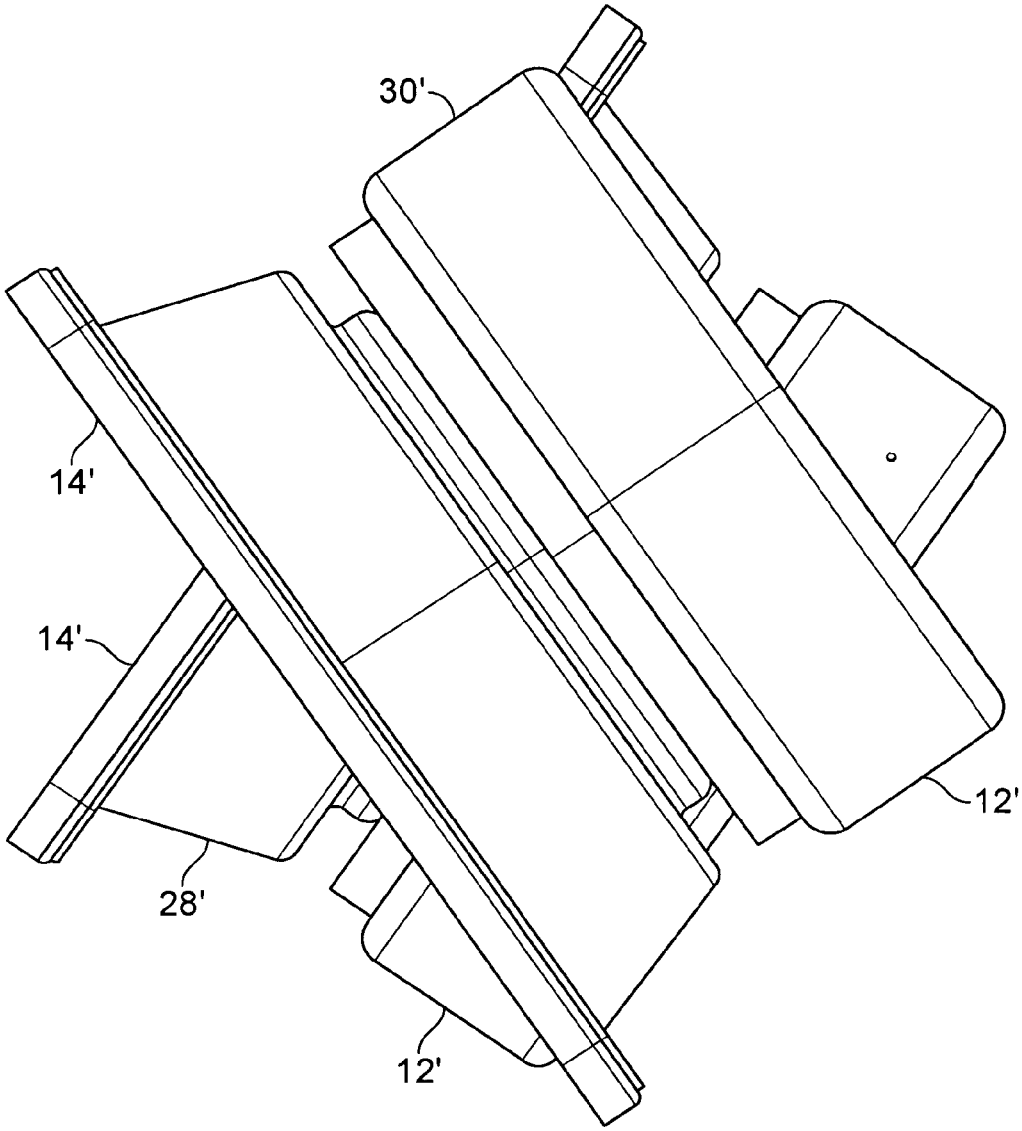

FIGS. 9A-9F, show views of a practical implementation of the line array loudspeaker according to the specification. Elements of FIGS. 9A-9E corresponding to elements of other figures are identified with a prime (') designator. The correspondence of numbers is for illustration and is not limiting. For example, an element 28' of FIGS. 9A-9E may also correspond to element 30 of other figures. FIG. 9A is a view of a line array incorporating the features of FIGS. 3, 5C, 7B, and 8. The line array of FIG. 9A consists of two sections 62 and 64 which can be joined along line 66 to form a longer line array. FIG. 9B is an enlarged front view of the arrangement of some of the acoustic drivers of the line array of FIG. 9A. In one implementation, the line array includes 24 2.25 inch acoustic drivers manufactured by Bose Corporation of Framingham, Mass., USA. The drivers are densely spaced, so that the edges 50 are less than one inch apart. FIG. 9C is a side view of the arrangement of the line array. FIG. 9D is a front view of the arrangement of the acoustic drivers, with a structure 52 that holds the acoustic drivers in the orientation of FIG. 9B. FIG. 9E is an enlarged isometric view of the arrangement of some of the acoustic drivers of the line array of FIG. 9A. FIG. 9E is a top view of the acoustic drivers. FIG. 9E illustrates another feature of the line array. The structure 52 includes a "shelf" 54 that may affect the radiation of the acoustic driver above, and a similar shelf that may affect the radiation of the acoustic driver below. If the acoustic drivers are arranged so that the centers of the dust caps are aligned, as described above in the discussion of FIG. 5 and the acoustic drivers are arranged so that the angle $\theta$ of FIG. 4 is 90 degrees, the vertical dispersion is wide, but the shelves may affect radiation pattern of the line array, and the line array may be undesirably bulky. Aligning the dust caps and arranging the acoustic drives so that the angle $\theta$ of FIG. 4 is 70 degrees results in an acceptable vertical dispersion, but with only minor affect of the shelves on the radiation of the line array. A line array according to FIGS. 9A-9F with the dust caps aligned and the acoustic drivers arranged so that angle $\theta$ of FIG. 4 is 70 degrees results in a frequency response that varies by less than ±2 dB (that is, varies substantially inaudibly) in an angle $\psi$ (see FIG. 7D) of 120 degrees.

Figure 10A:
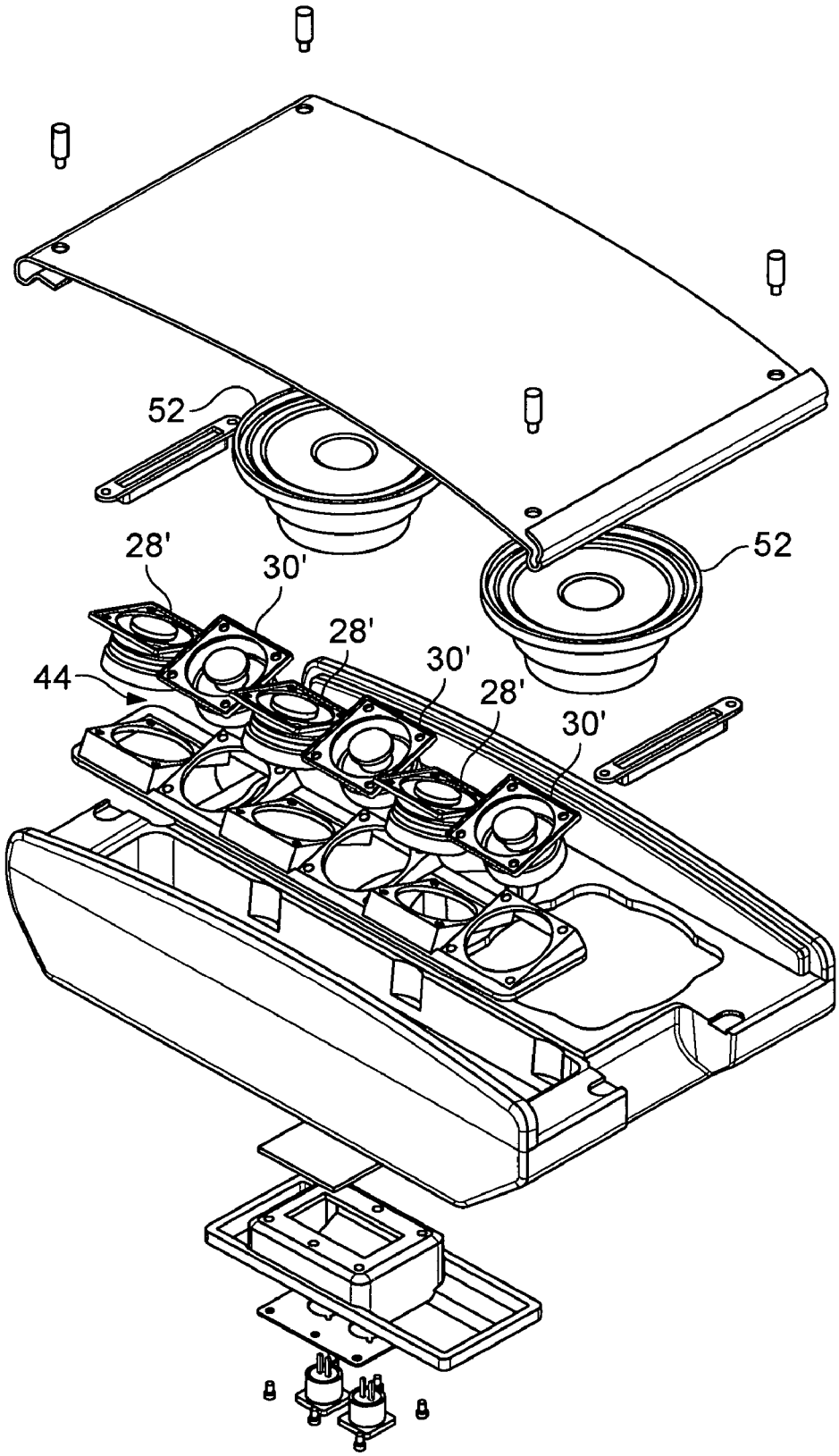
FIGS. 10A and 10B are exploded views of a line array configured to be used as a monitor loudspeaker.
Figure 10B:
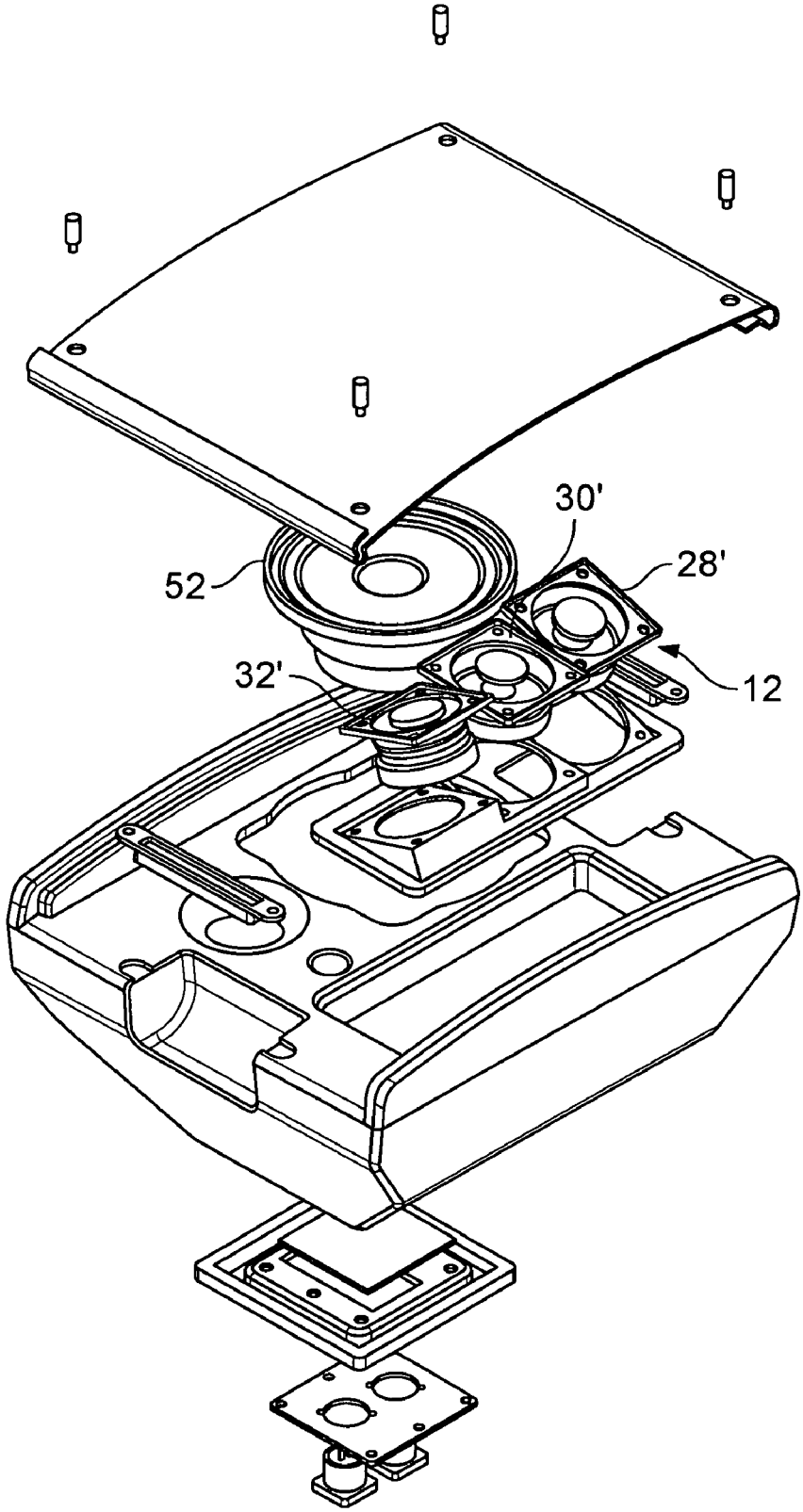

FIGS. 10A and 10B are exploded views of a monitor loudspeaker including the line array loudspeakers 42 and 44 of FIG. 6. Elements of FIGS. 9A and 9B corresponding to elements of FIG. 6 are identified with a like reference number and a prime (') designator. The line arrays of FIGS. 10A and 10B include bass acoustic drivers 52 mounted in the same cabinet as the line arrays.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. A line array loudspeaker, comprising:

a first plurality of acoustic drivers each acoustic driver comprising an axis, the first plurality of acoustic drivers arranged so that the axes of first plurality of acoustic drivers are coplanar in a first plane and so that a straight line intersects each axis at a same position on each of the first plurality of acoustic drivers;

a second plurality of acoustic drivers each acoustic driver comprising an axis, the second plurality of acoustic drivers arranged so that the axes of second plurality of acoustic drivers are coplanar in a second plane and so that the straight line intersects each axis at a same position on each of the second plurality of acoustic drivers, the first plurality and the second plurality arranged so that the first plane intersects with the second plane along a straight intersection line at an angle that is non-adjustable, fixed and greater than zero degrees and less than 90 degrees.

2. A line array loudspeaker in accordance with claim 1, wherein the first plurality of acoustic drivers and the second plurality of acoustic drivers are interleaved.

3. A line array loudspeaker in accordance with claim 1, wherein the axes of at least two of the first plurality of acoustic drivers are parallel.

4. A line array loudspeaker in accordance with claim 1, wherein the same position of each of the first plurality of acoustic drivers and the same position of each of the second plurality of acoustic drivers is on the dust cap.

5. A loudspeaker device, comprising:

first, second, and third acoustic drivers each acoustic driver comprising an axis, arranged along a straight line so that the axes of the acoustic drivers are perpendicular to the line;

the first, second, and third acoustic drivers further arranged so that the axes of adjacent acoustic drivers are non-parallel, wherein a projection onto an azimuth plane of the first driver axis and a projection onto the azimuth plane of the second driver axis intersect at an angle $\theta$ that is non-adjustable, fixed and less than 90 degrees, and wherein the projection onto an azimuth plane of the second driver axis and a projection onto the azimuth plane of the third driver axis intersect at an angle $\phi$ that is non-adjustable, fixed and greater than zero degrees and less than 90 degrees.

6. A loudspeaker device in accordance with claim 5, wherein $\phi=-\theta$, so that the projection of the first driver and the projection of the third driver intersect at an angle $2\theta$.

7. A loudspeaker device in accordance with claim 5, wherein $\phi=\theta$ so that the projection of the first driver and the projection of the third driver are coincident.

8. A loudspeaker in accordance with claim 7, further comprising a fourth acoustic driver comprising an axis, arranged along the line so that a projection onto the azimuth plane of the fourth driver axis and the projection of the second driver axis are coincident.

9. A loudspeaker device in accordance with claim 5, wherein the line passes through the dust covers of the first, second, and third acoustic drivers.

10. A loudspeaker device, comprising:

a first plurality of acoustic drivers each acoustic driver comprising an axis, the plurality of acoustic drivers arranged along a straight line so that the axes of first plurality of acoustic drivers are parallel; and a second plurality of acoustic drivers, arranged along the line so that the axes of the second plurality of acoustic drivers are parallel and so that a projection onto an azimuth plane of the axes of the second plurality of acoustic drivers intersects with a projection onto the azimuth plane of the axes of the first plurality of acoustic drivers at a non-adjustable, fixed angle that is greater than zero degrees and less than 90 degrees.

11. A loudspeaker device in accordance with claim 10, wherein the first plurality of acoustic drivers and the second plurality of acoustic drivers are ordered so that each pair of the first plurality is separated by one of the second plurality.

12. A loudspeaker device in accordance with claim 10, wherein the loudspeaker device is constructed and arranged to be placed on a surface so that the line is non-perpendicular to the surface.

13. A loudspeaker device in accordance with claim 10, constructed and arranged to be selectively placed in one of a first orientation in which the line is parallel to the surface or of a second orientation in which the line is non-parallel to the surface.

14. A loudspeaker device in accordance with claim 10, wherein the first plurality of acoustic drivers and the second plurality of acoustic drivers are constructed and arranged to radiate pressure waves in a first frequency band, the loudspeaker device further comprising an additional acoustic driver to radiate pressure waves in a second frequency band.

15. A monitor loudspeaker comprising:

first, second, and third acoustic drivers, arranged along a straight line so that a projection of the axis of the first acoustic driver and a projection of the axis of the second acoustic driver intersect at a non-adjustable, fixed angle that is greater than zero degrees and less than 90 degrees;

so that a projection of the axis of the first acoustic driver and a projection of the axis of the third acoustic driver intersect at a non-adjustable, fixed angle that is greater than zero degrees and less than 90 degrees; and so that a projection of the axis of the second acoustic driver and a projection of the axis of the third acoustic driver intersect at a non-adjustable, fixed angle that is greater than zero degrees and less than 90 degrees.

16. A monitor loudspeaker in accordance with claim 15, constructed and arranged to be placed on a planar surface, so that the line is non-perpendicular to the surface.

17. A monitor loudspeaker in accordance with claim 16, further constructed and arranged to be selectively placed in one of a first orientation in which the line is parallel to the surface or of a second orientation in which the line is non-parallel to the surface.

18. A loudspeaker device in accordance with claim 15, wherein the straight line passes through a dust cover of each acoustic driver.

19. A loudspeaker device in accordance with claim 15, wherein the straight line passes through the dust covers of the acoustic drivers of the first and second plurality of acoustic drivers.

20. A loudspeaker system, comprising:

a first loudspeaker array, the first array comprising an enclosure having a width and a height and at least six acoustic drivers each having a radiating surfaces and an axis, each of the acoustic drivers having a diameter less than three inches, wherein the at least six drivers are positioned in the enclosure in a first substantially straight line, substantially regularly spaced so that the edges of the radiating surfaces are less than two inches apart, wherein the first array is designed and constructed to radiate sound wherein the acoustic drivers of a first subset of the first array have axes in a first common plane and the acoustic drivers of a second subset of the first array has axes in a second common plane and wherein the first common plane and the second common plane intersect along a straight line at a non-adjustable, fixed angle that is greater than zero degrees and less than 90 degrees.

21. A loudspeaker system in accordance with claim 20 wherein the acoustic drivers of the first subset are interleaved with the acoustic drivers of the second subset.

22. A loudspeaker system in accordance with claim 20 further comprising a second loudspeaker array having an enclosure and a plurality of acoustic drivers having radiating surfaces, each of the drivers having a diameter of less than three inches, the drivers positioned in the enclosure in a second substantially straight line, regularly spaced less than one inch apart, wherein the second loudspeaker device is designed and constructed to be attached to the first loudspeaker device in a manner that extends the first substantially straight line so that the height is increased and so that the width remains constant.

23. A loudspeaker system in accordance with claim 22, wherein the first loudspeaker array is portable.

24. A loudspeaker system, comprising:

a first portable array module, comprising a portable enclosure, and at least six acoustic drivers, positioned in the enclosure in a substantially straight line, wherein the first portable array module comprises two subarrays comprising acoustic drivers, each having an axis wherein a projection of the axes of the first subarray onto an azimuth plane intersects with a projection onto an azimuth plane intersects with a projection of the axes of the second subarray at a non-adjustable, fixed angle that is less than 90 degrees;

a second portable array module, comprising a portable enclosure, and at least six acoustic drivers, positioned in the enclosure in a substantially straight line, wherein the second portable array module comprises two subarrays comprising acoustic drivers, each having an axis wherein a projection of the axes of the first subarray onto an azimuth plane intersects with a projection onto an azimuth plane intersects with a projection of the axes of the second subarray at a non-adjustable, fixed angle that is greater than zero degrees and less than 90 degrees; and an attachment system for attaching the first array to the second portable array in a manner so as to extend the substantially straight line.

25. A line array loudspeaker according to claim 1, wherein the non-adjustable, fixed angle is 70 degrees.

26. A loudspeaker device, according to claim 5, wherein the angle $\phi$ is 70 degrees.

27. A loudspeaker device according to claim 10 wherein the non-adjustable, fixed angle is 70 degrees.

28. A monitor loudspeaker according to claim 15, wherein the non-adjustable, fixed angle is 70 degrees.

29. A loudspeaker system according to claim 20, wherein the non-adjustable, fixed angle is 70 degrees.

30. A loudspeaker system according to claim 24, wherein the non-adjustable, fixed angle is 70 degrees.

* * * * *